US007611553B2

(12) United States Patent
Hato

(10) Patent No.: US 7,611,553 B2
(45) Date of Patent: Nov. 3, 2009

(54) DUST COLLECTOR AND VACUUM CLEANER PROVIDED WITH THE SAME

(75) Inventor: Shigenori Hato, Kishiwada (JP)

(73) Assignee: Sharp Kabushiki Kaisha, Osaka (JP)

( * ) Notice: Subject to any disclaimer, the term of this patent is extended or adjusted under 35 U.S.C. 154(b) by 460 days.

(21) Appl. No.: 11/526,020

(22) Filed: Sep. 25, 2006

(65) Prior Publication Data

US 2007/0186522 A1 Aug. 16, 2007

(30) Foreign Application Priority Data

Oct. 4, 2005 (JP) ..... 2005-291049

(51) Int. Cl.
*B01D 46/00* (2006.01)

(52) U.S. Cl. ..... 55/289; 55/283; 55/288; 55/296; 55/297

(58) Field of Classification Search ..... 55/282, 55/283, 289, DIG. 2, DIG. 3, 288, 295, 296, 55/297, 299, 300, 304, 305, 301, 302, 293, 55/294; 15/347, 352, 353; 210/413; 95/276; 209/254, 316

See application file for complete search history.

(56) References Cited

U.S. PATENT DOCUMENTS 3,145,164 A * 8/1964 Johkman ..... 209/254
3,246,754 A * 4/1966 Sackett ..... 209/316
4,214,878 A * 7/1980 Weiss ..... 95/276
4,983,290 A * 1/1991 Schumann ..... 210/413

FOREIGN PATENT DOCUMENTS

EP 1136028 A2 * 9/2001 ..... 55/289
JP 2002-051949 2/2002
JP 2002-315701 10/2002

* cited by examiner

*Primary Examiner*—Duane Smith
*Assistant Examiner*—Minh-Chau T Pham
(74) *Attorney, Agent, or Firm*—Birch, Stewart, Kolasch & Birch, LLP

(57) ABSTRACT

There are provided a dust collector for cleaning dirt, dust, etc. adhering to a filter in association with the operation for opening and closing a cap of the dust collector, and a vacuum cleaner provided with the dust collector. The dust collector 30 has a dust collection vessel having a cap 33*c* and a case 33*d*, a filter 34*a* for filtrating sucked dirt, dust, etc., and a ring 71 provided with a brush 70 for cleaning dirt, dust, etc. adhered to the filter 34*a*. The cap 33*c* is provided with support pins 73 that slide in association with the operation for opening the cap 33*c*, and the support pin 73 and the ring 71 are connected to each other. The ring 71 moves in association with the operation for opening the cap 33*c*, by which the filter 34*a* is cleaned.

13 Claims, 5 Drawing Sheets

DUST COLLECTOR AND VACUUM CLEANER PROVIDED WITH THE SAME

BACKGROUND OF THE INVENTION

1. Field of the Invention

The present invention relates to a dust collector and a vacuum cleaner provided with the dust collector.

2. Description of the Related Art

In a conventional vacuum cleaner, a dust collector is disposed in a suction passage that connects a suction port to a motor-driven blower, and dirt, dust, etc. are separated from air by a filter of this dust collector to exhaust only the air to the outside of a cleaner body. If the filter is clogged with dirt, dust, etc., the suction efficiency is decreased. Therefore, the filter must be cleaned periodically.

Japanese Patent Laid-Open No. 2002-315701 (refer to FIGS. 17 and 18) discloses a cyclone dust collector attached to the cleaner body, in which a dust case is detachably mounted to a cup-shaped cap fixed to the cleaner body; a brush is provided movably with respect to a dust collection filter provided in an exhaust cylinder on the cap side; a coil spring is interposed between the cap and the brush to move the brush along the filter in association with the opening operation of the dust case; and a connecting rod is provided to connect the brush to the dust case side in such a manner that they can be engaged with and disengaged from each other to move the brush in association with the attachment/detachment of the dust case.

In the above-described conventional dust collector, however, since the coil spring extends and contracts along the surface of filter, the coil spring is exposed to the suction passage. Therefore, dirt, dust, etc. adhere to the coil spring, which gives a poor appearance. Furthermore, there is a possibility that the user touches the coil spring inadvertently when a dust cup is opened.

Also, in the type as in Japanese Patent Laid-Open No. 2002-315701 in which the brush and the dust case are connected to each other by the rod, since the rod is connected from the brush portion in a dust collection vessel to the outside of the case through the inner peripheral surface on the cap side, the configuration for connecting the rod is complicated.

SUMMARY OF THE INVENTION

The present invention has been made in view of the above circumstances, and accordingly an object thereof is to provide a dust collector in which a filter of an exhaust cylinder can be cleaned in association with the opening/closing operation of a cap by using a simple cap opening/closing interlocking mechanism.

To achieve the above object, the present invention provides a dust collector having a dust collection vessel that includes an openable and closable cap and a case and an exhaust cylinder that has a filter and is provided in the dust collection vessel, the dust collector filtering, by the filter, dirt and dust that have been sucked together with air from a suction port of the dust collection vessel, exhausting the air from the exhaust cylinder, and recovering the dirt and dust in the dust collection vessel, wherein a cleaning member for cleaning the filter is provided movably along the axial direction of the exhaust cylinder; and a cap opening/closing interlocking means for moving the cleaning member in association with the opening/closing operation of the cap is provided, wherein the cap opening/closing interlocking means is composed of a movable member which is movable in the axial direction with respect to the exhaust cylinder, a plurality of connecting members arranged at intervals around the filter to connect the movable member and the cleaning member to each other, and an urging member interposed between the exhaust cylinder and the movable member to urge the movable member in the extension direction with respect to the exhaust cylinder.

According to the above-described configuration, since the urging member for urging the movable member in the extension direction with respect to the exhaust cylinder is interposed between the exhaust cylinder and the movable member, unlike the conventional configuration in which a coil spring is moved around the filter, dirt, dust, etc. can be prevented from adhering to the urging member, and also the performance of the urging member can be prevented from decreasing. Moreover, since the connecting members are provided at intervals around the filter to connect the movable member and the cleaning member to each other, there arises no problem in that the filter performance is decreased by the presence of connecting members.

Also, the present invention provides a dust collector having a dust collection vessel that includes an openable and closable cap and a case and an exhaust cylinder that has a filter and is provided in the dust collection vessel, the dust collector filtering, by the filter, dirt and dust that have been sucked together with air from a suction port of the dust collection vessel, exhausting the air from the exhaust cylinder, and recovering the dirt and dust in the dust collection vessel, wherein a cleaning member for cleaning the filter is provided movably along the axial direction of the exhaust cylinder; a cap opening/closing interlocking means for moving the cleaning member in association with the opening/closing operation of the cap is provided, wherein the cap opening/closing interlocking means is composed of a movable member which is movable in the axial direction with respect to the exhaust cylinder, a connecting member for connecting the movable member and the cleaning member to each other, and an urging member for urging the movable member in the extension direction with respect to the exhaust cylinder; an accommodation portion for accommodating the urging member is provided on one side of the exhaust cylinder; and the moving member is arranged so as to cover the accommodation portion.

According to the above-described configuration, the urging member for urging the movable member in the extension direction with respect to the exhaust cylinder is accommodated in the accommodation portion provided on one side of the exhaust cylinder, and the movable member is arranged so as to cover the accommodation portion. Therefore, even when the cap adopts an open posture, the urging member is not exposed, so that the user can be prevented from touching the urging member inadvertently, which provides safety.

Also, a configuration can be employed in which the movable member is seated on the bottom surface of the case when the cap adopts a closed posture. According to the above-described configuration, since the movable member is seated on the bottom surface of the case against the urging member when the cap adopts a closed posture, the exhaust cylinder is supported in a both ends supported state by the cap and the case. Therefore, the exhaust cylinder has a stable construction.

Also, the configuration may be such that the cleaning member and the movable member are connected to each other by the connecting member so that the cleaning member is located in one end portion of filter when the cap adopts a closed posture, and is located in the other end portion of filter when the cap adopts an open posture.

According to the above-described configuration, when the cap adopts a closed posture or an open posture, the cleaning member is always located in the end portion of the filter. Therefore, except when the filter is cleaned, a portion through which the sucked air passes is not covered by the cleaning member, so that the filter performance is not impaired.

Also, the dust collector is mounted detachably in a cleaner body. Thereby, in the state in which the dust collector is removed from the cleaner body, the cap and the case are separated from each other and thus dirt, dust, etc. recovered in the dust collection vessel can be disposed of, so that the dust collector is easy to use.

As described above, according to the present invention, in a cap opening/closing interlock mechanism for moving the cleaning member along the filter of the exhaust cylinder in association with the opening/closing operation of the cap of the dust collector, the urging member is provided to urge the movable member constituting the interlock mechanism in the extension direction with respect to the exhaust cylinder, and the urging member is interposed between the exhaust cylinder and the movable member. Therefore, unlike the conventional configuration in which a spring is moved around the filter, dirt and dust can be prevented from adhering to the urging member, and a dust collector having a good appearance can be provided. Moreover, if the urging member is accommodated in the accommodation portion formed in the end portion of the exhaust cylinder and is covered by the movable member, the urging member is not exposed, so that the user can be prevented from touching the urging member inadvertently, which provides safety.

DETAILED DESCRIPTION OF THE INVENTION

An embodiment of the present invention will now be described by taking a self-propelled vacuum cleaner moving in a surrounded space in which obstacles such as walls, furniture, beds, etc. are present in a self-sustained manner as an example.

Figure 1:
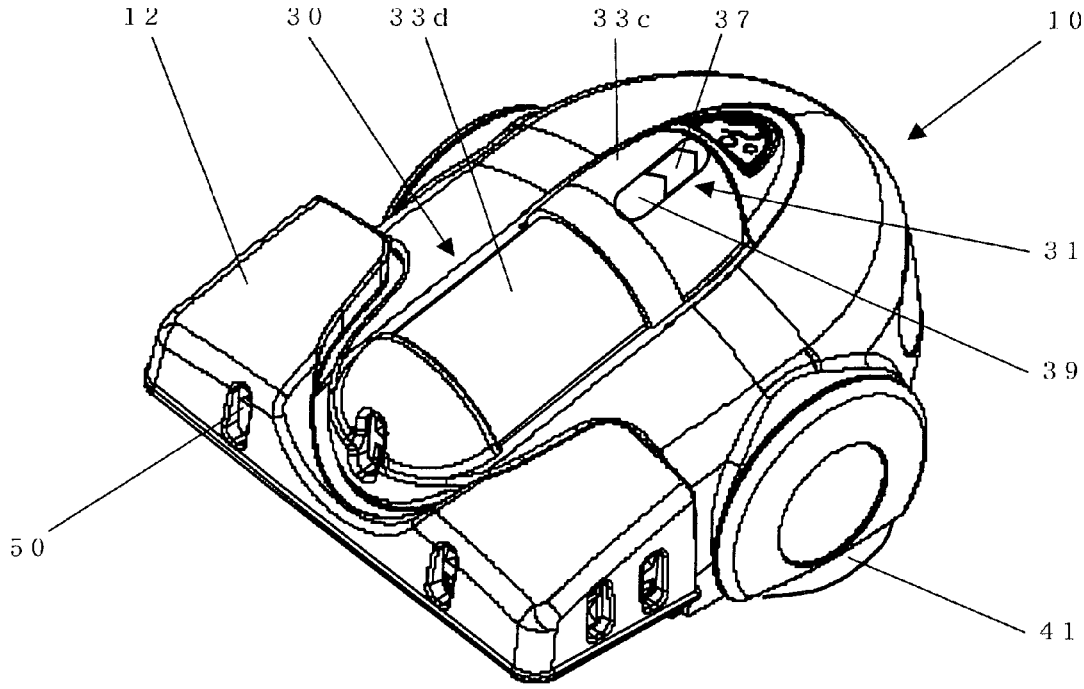
FIG. 1 is a perspective view of a self-propelled vacuum cleaner in accordance with the present invention.
Figure 2:
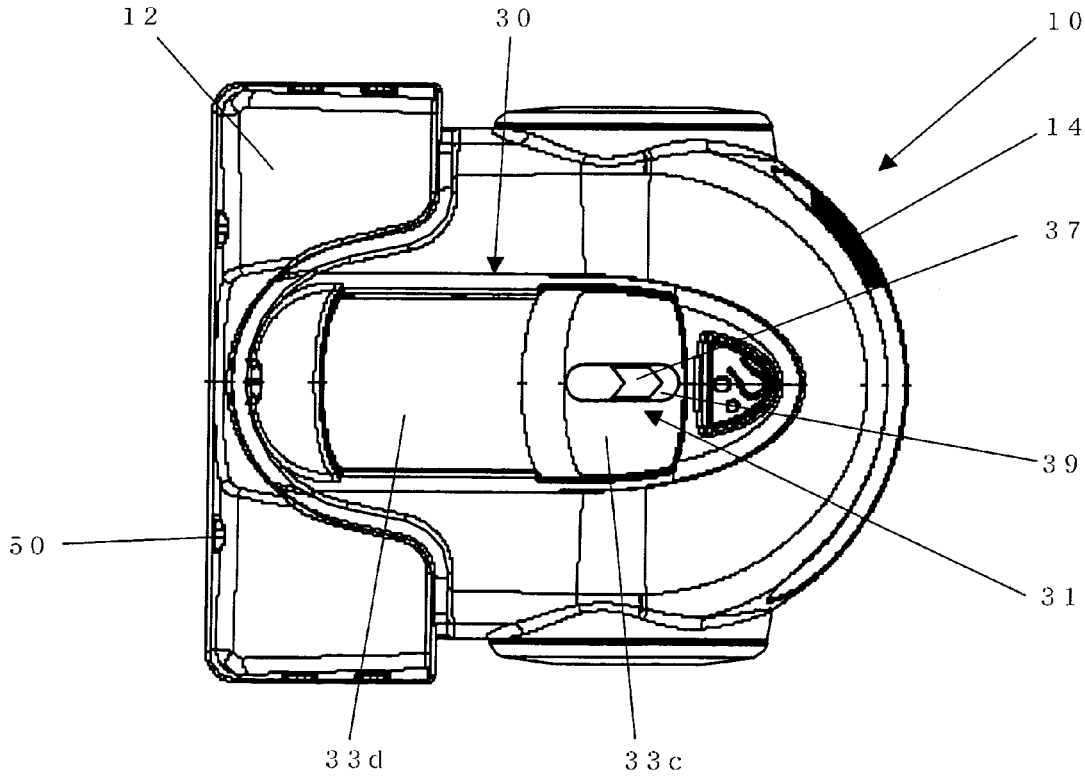
FIG. 2 is a top view of the self -propelled vacuum cleaner.
Figure 3:
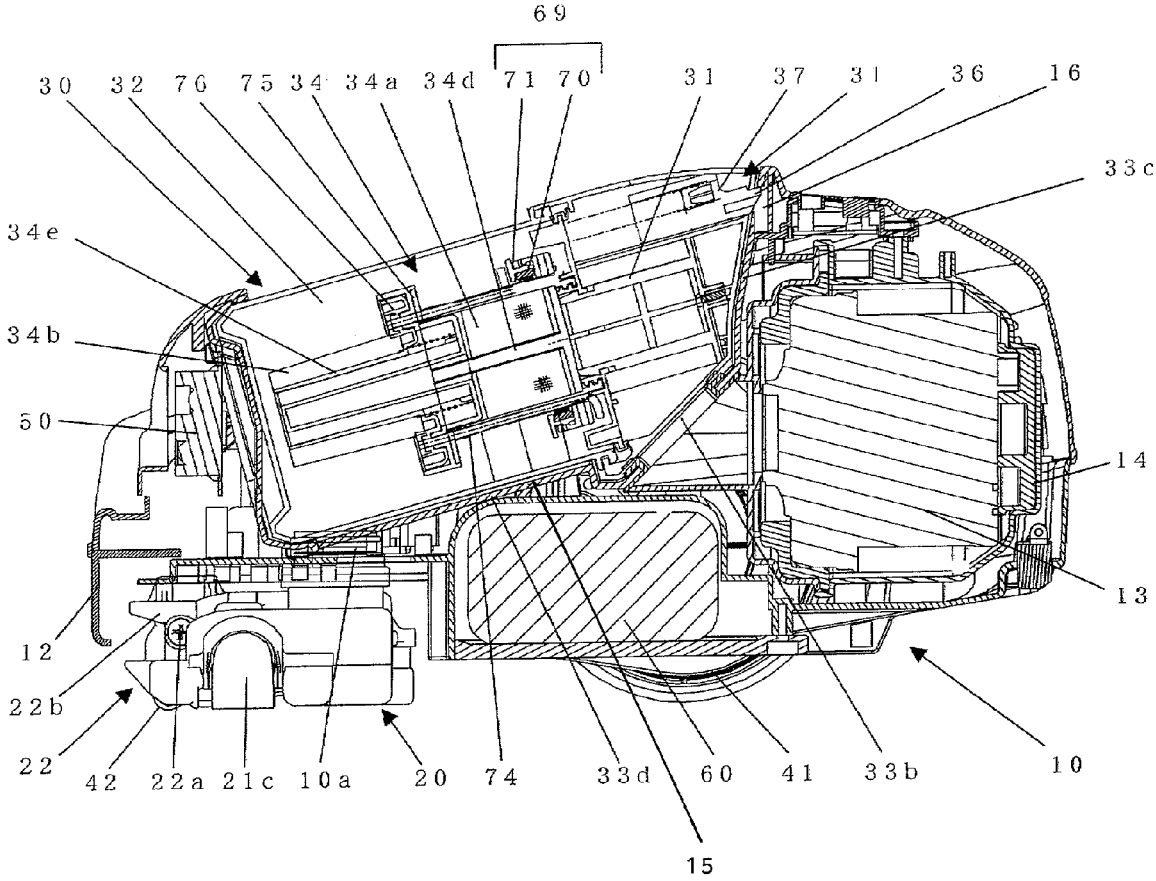
FIG. 3 is a side sectional view of the self-propelled vacuum cleaner.

As shown in FIGS. 1 to 3, the self-propelled vacuum cleaner has a cleaner body 10 incorporating a motor-driven blower 13 and a suction port body 20 for sucking dirt, dust, etc. on the floor surface. The suction port body 20, which is disposed on the bottom surface on the front side of the cleaner body 10, is connected to the cleaner body 10 by a connecting shaft 10*a* whose axis direction is vertical, and is turnable in the range of about 30 degrees around the connecting shaft 10*a*. Also, the suction port body 20 is connected with a flexible suction hose (not shown) on the cleaner body 10 side so that dirt, dust, etc. can be sucked from the suction port body 20 into a dust collector 30 on the cleaner body side by the suction force generated by the driving of the motor-driven blower 13.

The cleaner body 10 is formed with a concave portion 15 for accommodating the capsule-like dust collector 30 on the upper surface of an oval casing. On the front side of the casing, a bumper 12 for cushioning a shock at the time of collision with an obstacle, wall surface, etc. is installed. On the rear side of the cleaner body 10, the motor-driven blower 13 is incorporated. Also, at both sides of the cleaner body 10, driving wheels 41 are provided as moving means for moving the vacuum cleaner in a cleaning space. A control section 60 provided with a control circuit board etc. for controlling the driving of the driving wheels 41 and the motor-driven blower 13 is disposed in a space below the concave portion 15. Furthermore, sensors 50 for sensing an obstacle existing around the vacuum cleaner are provided so as to face to windows in the bumper 12.

The bumper 12 is held by a spring (not shown) so as to project to the front side of the cleaner body 10 to cushion a shock.

The moving means includes the paired right and left driving wheels 41 that are driven by driving motors (not shown) and an auxiliary wheel 42 provided on the lower surface of the suction port body 20. The right and left driving wheels 41 are rotated independently. For example, when the vacuum cleaner advances or retreats, both of the driving wheels 41 are rotated simultaneously, and when the vacuum cleaner is turned, each of the driving wheels 41 is rotated in the different direction, or one of the driving wheels 41 is stopped and the other of the driving wheels 41 is rotated. The auxiliary wheel 42 is supported so as to be turnable around the vertical axis so that the cleaner body 10 can run smoothly in conformance with the movement of the driving wheels 41.

Figure 4A:
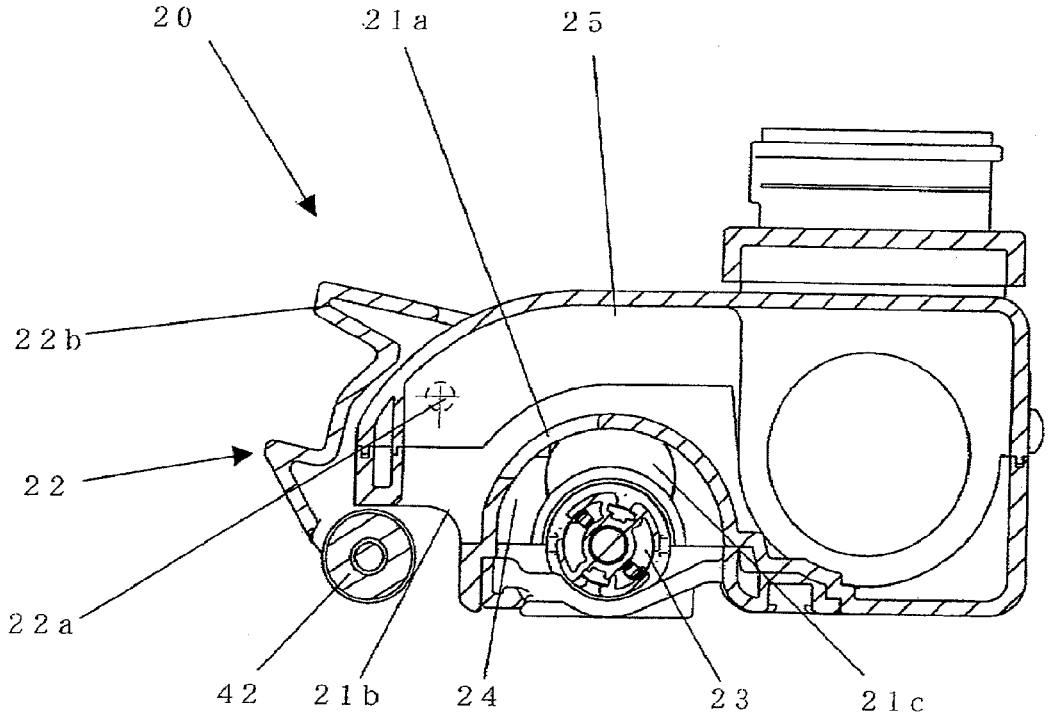
FIG. 4 is side sectional views of a suction port body, FIG. 4(A) showing a state in which an opening/closing portion is open, and FIG. 4(B) showing a state in which the opening/closing portion is closed.
Figure 4B:
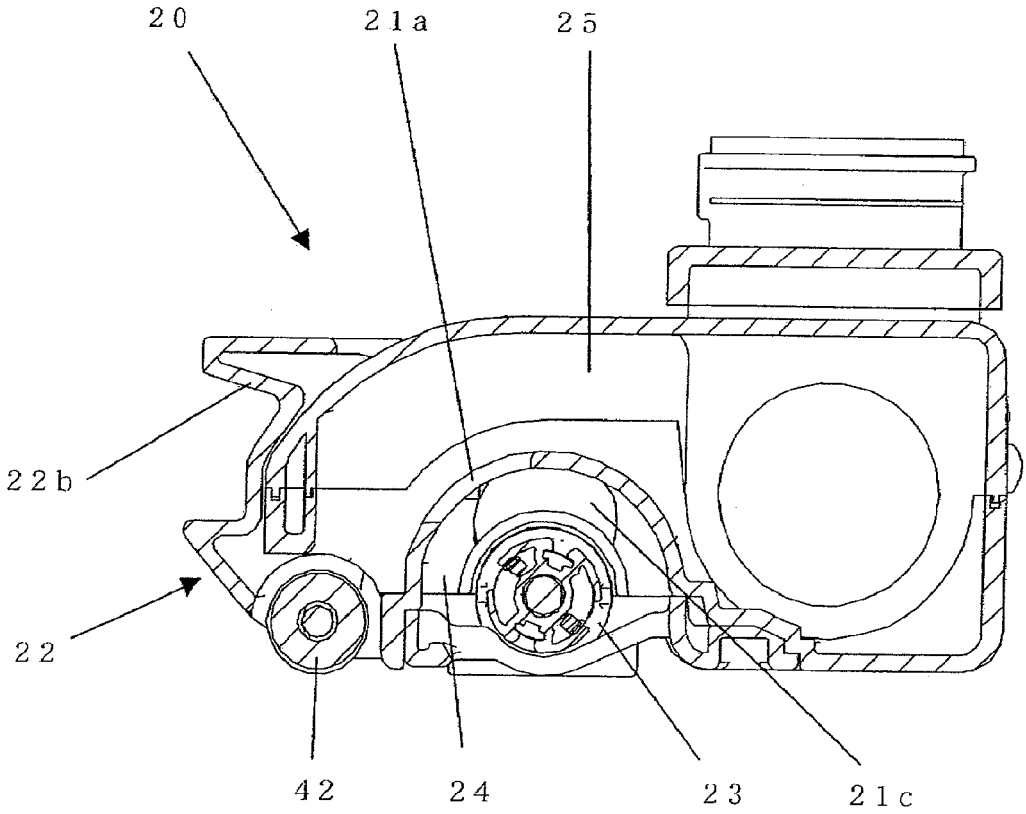

As shown in FIGS. 4(A) and 4(B), the suction port body 20 is formed with a main suction port 21*a* for sucking dirt, dust, etc., a front suction port 21*b*, and side suction ports 21*c* (see FIG. 1). The main suction port 21*a* and the front suction port 21*b* each has an opening communicating with a suction passage 25 formed in the suction port body 20, and the side suction port 21*c* has an L-shaped nozzle formed of rubber or the like.

The main suction port 21*a* is formed by penetrating the wall surface of a concave portion 24 provided in the center on the bottom surface of the suction port body 20. In this concave portion 24, a rotating brush 23 for scraping up dirt, dust, etc. from the floor surface is rotatably provided so that the dirt, dust, etc. scraped up by the rotation of the rotating brush 23 can be sucked through the main suction port 21*a*.

The side suction ports 21*c* are provided at the right and left of the suction port body 20, and communicate with the concave portion 24 so that the dirt, dust, etc. sucked through the side suction ports 21*c* are allowed to flow into the suction passage 25 through the main suction port 21*a*.

Also, the front suction port 21*b* is formed on the bottom surface on the front side of the suction port body 20. On this front side, an opening/closing portion 22 that is opened and closed by the movement of the bumper 12 is provided. The opening/closing portion 22 is supported so that the both side surface upper sides thereof is turnable around a shaft 22*a* of the suction port body 20 to open and close the front suction port 21*b*. On the front surface of the opening/closing portion 22, there is projectingly provided a contact portion 22*b* that comes into contact with the bumper 12 when the bumper 12 hits an obstacle, wall, etc. and is pushed in to the rear side of the cleaner body 10. The bumper 12 and the opening/closing portion are configured such that when the bumper 12 hits the contact portion 22*b*, the opening/closing portion 22 is turned so as to be opened, and when the bumper 12 separates from the contact portion 22*b*, the opening/closing portion 22 is turned so as to be closed by the gravity thereof Thereby, the front suction port 21*b* is opened and closed.

Next, the dust collector 30 is explained with reference to FIGS. 5 and 6. The dust collector 30 is of a cyclone type, and is detachably accommodated in the concave portion 15 formed on the upper surface of the cleaner body 10. The concave portion 15 is formed so as to have a semicircular cross section. On the rear side of the concave portion 15, a flat inclined surface 15*a* is formed, so that the insertion direction of the dust collector 30 is regulated. In the bottom surface of the concave portion 15, a suction port 17 that communicates with the suction passage 25 leading from the suction port body 20 is formed. In the inclined surface 15*a* of the concave portion 15, an exhaust port 18 that communicates with the motor-driven blower 13 in the cleaner body 10 is formed.

The cyclone type is a type in which the intake air containing dirt, dust, etc., which is sucked from the suction port body 20 into a dust collection chamber 32, is swirled in the dust collection chamber, by which dirt and dust are separated from the air, and the sucked air is discharged to the outside of the dust collection chamber.

Figure 5:
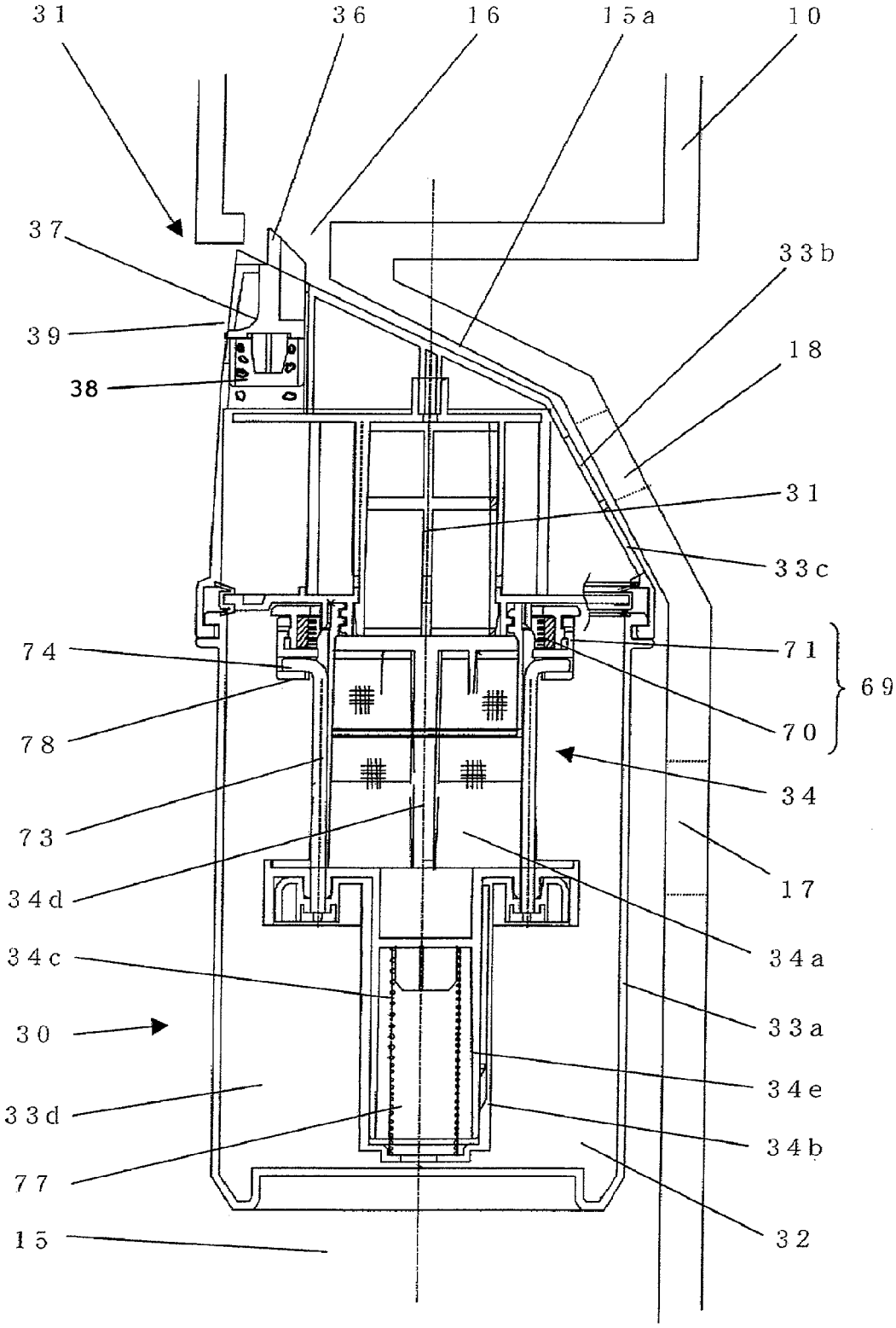
FIG. 5 is a side sectional view of a dust collector.
Figure 6:
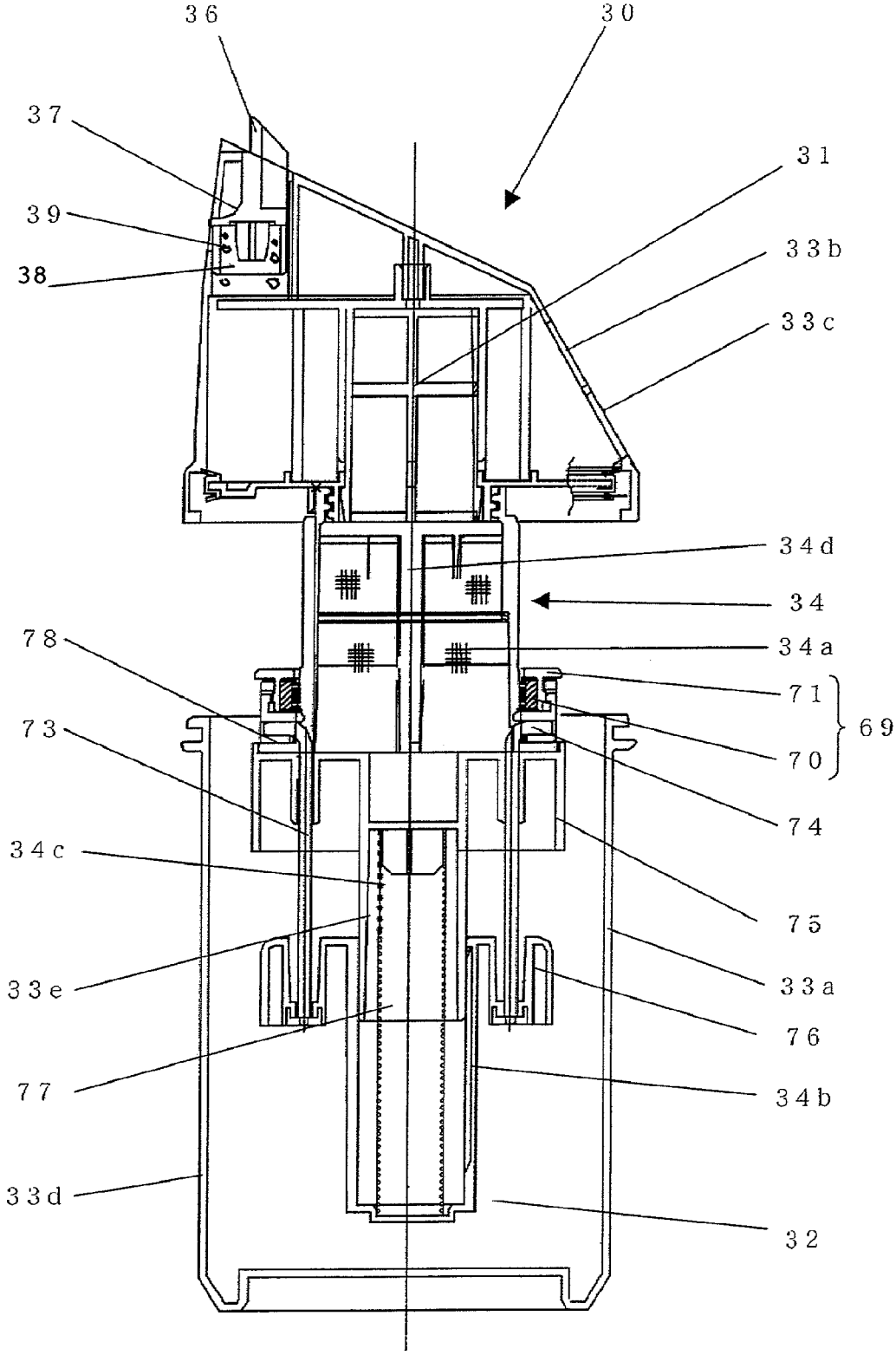
FIG. 6 is a view showing a separated dust collection vessel.

As shown in FIG. 5, the dust collector 30 includes a capsule-like dust collection vessel forming the dust collection chamber 32 therein and an exhaust cylinder 34 disposed in the center of the dust collection chamber 32 in the dust collection vessel. The dust collection vessel has a semi-cup shaped cap 33*c* and a case 33*d*, and in the opening edge portions of the mating surfaces thereof, threads for threaded engagement are formed.

For the cap 33*c*, on the lower surface side (the lower side of the cleaner body 10) thereof, a slant surface is formed in conformance with the inclined surface 15*a* of the concave portion 15, and the upper surface side (the upper side of the cleaner body 10) thereof is formed into a semi-cylindrical shape in conformance with the capsule shape. On the lower surface side of the cap 33*c*, a dust collection vessel exhaust port 33*b* communicating with the exhaust port 18 is formed. Also, in the cap 33*c*, the exhaust cylinder 34 is fixed along the axial direction with screws.

Also, on the upper surface side of the cap 33*c* of the dust collection vessel, an elongated groove 39 is formed in the front and rear direction (the front and rear direction of the cleaner body 10), and an operation lever 37 is slidably fitted in the elongated groove 39. The elongated groove 39 is formed to the rear surface side of the cap 33*c*, and the end portion thereof is open so that a clamp 36 integrally formed at the rear end of the operation lever 37 can project from the rear surface of the cap 33*c*. Between the operation lever 37 and the front part of the elongated groove 39, a spring 38 is interposed so that the operation lever 37 is urged to the rear.

The clamp 36 integrated with the operation lever 37 functions as an engagement portion that detachably engages with an engagement hole 16 formed in the concave portion 15 of the cleaner body 10. When the operation lever 37 is slid to the front, the clamp 36 disengages from the concave portion 15 of the cleaner body 10, by which the dust collector 30 can be removed from the cleaner body 10.

The exhaust cylinder 34, which is used to exhaust the air from which dirt and dust have been separated from the dust collection chamber 32 to the dust collection vessel exhaust port 33*b* through a cylindrical body 31, includes the cylindrical body 31 screwed to the cap 33*c* and a fixed cylinder 34*d* detachably attached to the end portion in the axial direction of the cylindrical body 31. The peripheral surface of the cylindrical body 31 is open in a lattice form so that the air sucked into the cylindrical body 31 can be exhausted through the dust collection vessel exhaust port 33*b*.

The dust collection vessel exhaust port 33*b* and the exhaust port 18 on the concave portion 15 side are connected to each other so as to face to each other or by using a hose (not shown) to form the suction passage 25.

The fixed cylinder 34*d* is mounted with a mesh-form filter 34*a* so as to close the openings in the outer peripheral surface of the fixed cylinder 34*d*, and a cleaning member 69 is arranged on the outer periphery side thereof. The filter 34*a* is located on the outside of the opening portion of the cap 33*c* so as to be exposed to the outside when the cap 33*c* is removed from the case 33*d*, and can be removed for cleaning.

On the lower surface side (the lower side of the cleaner body 10) of the case 33*d*, a dust collection vessel suction port 33*a* communicating with the suction port 17 in a concave portion 15 is formed. The dust collection vessel suction port 33*a* and the suction port 17 are connected to each other so as to face each other or by using a hose (not shown) to form the suction passage 25.

The cleaning member 69 includes an annular ring 71 which is fitted on the filter 34*a* of the fixed cylinder and moves along the axial direction of the filter 34*a*, and a brush 70 which is provided on the inner peripheral surface of the ring 71 and slides along the outer peripheral surface of the filter 34*a*.

The brush 70 is provided on the inner surface of the ring 71, and consists of fibers having moderate elasticity. The bristle length of the brush 70 is of such a length that the tip end of bristle comes slightly into contact with the outer peripheral surface of the filter 34*a*.

The cleaning member 69 is slid along the axial direction of the filter 34*a* by opening and closing the cap 33*c*. Hereunder, the interlocking mechanism for the opening and closing of the cap 33*c* is explained. This cap opening/closing interlocking mechanism includes a movable member or a movable cylinder 34*b* which is fitted at the front end of the fixed cylinder 34*d* movably along the axial direction of the fixed cylinder 34*d* and the front end of which is seated on the inside bottom surface (the front side of the cleaner body 10) of the case 33*d* when the cap 33*c* adopts a closed posture, a spring 34*c* which is an urging member interposed between the movable cylinder 34*b* and the fixed cylinder 34*d* so as to urge the movable cylinder 34*b* in the extension direction, and support pins 73 serving as connecting members for connecting the movable cylinder 34*b* and the ring 71 to each other so that the ring 71 is moved along the filter 34*a* in association with the extension of the movable cylinder 34*b* due to the opening of the cap 33*c*.

In the center of a front part (the front side of the cleaner body 10) of the fixed cylinder 34*d*, a guide body 34*e* for guiding the movable cylinder 34*b* is projectingly formed. The guide body 34*e* is formed into a cylindrical shape the front end side of which is open, and an accommodation portion 77 for accommodating the urging member is formed in the guide body 34*e*. The movable cylinder 34*b* is formed into a cylindrical body the front end of which is closed, and is slidably fitted on the guide body 34*e*.

The spring 34*c* consists of a coil spring, and is interposed between the front end portion (the front side of the cleaner body 10) of the fixed cylinder 34*d* and the rear end portion (the rear side of the cleaner body 10) of the movable cylinder 34*b*. Specifically, the spring 34 is interposed between the inside rear part of the accommodation portion 77 and the inside bottom surface of the movable cylinder 34*b*.

The support pins 73 -are provided movably along recesses in the front and rear direction (the front and rear direction of the cleaner body 10) at four places around the fixed cylinder 34*d*. The rear end of the support pin 73 is bent to the outside on the front end portion side of the ring 71 to form a hook portion 74, and the hook portion 74 engages with a holding portion 78 formed on the front side of the ring 71. Also, the front end of the support pin 73 penetrates a flange 75 of the fixed cylinder 34*d* and is fixed to a flange 76 of the movable cylinder 34*b*. Thereby, the ring 71 and the movable cylinder 34*b* are connected integrally to each other.

In the above-described configuration, if the clamp 36 is retreated from the engagement hole 16 in the concave portion 15 of the cleaner body by operating the operation lever 37 of the dust collector 30, the dust collector 30 itself can be removed from the cleaner body.

After the dust collector 30 has been removed from the cleaner body, if the cap 33*c* of the dust collection vessel is opened, the movable cylinder 34*b* is extended with respect to the exhaust cylinder 34 by the urging force of the spring 34*c*, and accordingly the brush 70 of the cleaning member 69 slides along the filter 34*a* via the support pins 73.

At this time, the brush 70 moves on the surface of the filter 34*a*, and scrapes off dirt, dust, etc. adhering to the filter 34*a*. The scraped-off dirt and dust are received by the case 33*d*, and are accumulated. This scraping-off operation is performed from one end portion of the filter 34*a* to the other end portion thereof.

Also, after the dirt and dust accumulated in the case have been disposed of, when the cap 33*c* is closed, the front end of the movable cylinder 34*b* is seated on the inside bottom surface of the case 33*d*. In this state, the cap 33*c* is still in an open state. Therefore, if the cap is further closed against the urging force of the spring 34*c*, the movable cylinder 34*b* contracts against the force of the spring 34*c*, and accordingly the cleaning member 69 connected to the support pins 73 also moves from the front side to the rear side along the filter 34*a*.

By this movement of the cleaning member 69, the brush 70 is moved along the filter 34*a* to clean the filter 34*a* again. This cleaning operation of the cleaning member is performed each time the cap 33*a* is opened and closed.

Even at the time of this cleaning operation and the ordinary dust collection operation, the spring 34*c* is accommodated in the accommodation portion 77 of the exhaust cylinder 34 and is not exposed to the outside, so that the appearance is good. Also, since the user does not touch the spring 34*c* inadvertently, a safe dust collector can be provided. Also, the support pins 73 are arranged in a frame portion that does not affect the filter performance, though around the filter 34*a*, at the periphery of the fixed cylinder 34*d*. Therefore, the performance of the filter 34*a* is not impaired. Even if the support pins 73 are arranged in the filter portion, no problem arises in terms of filter performance because the diameter of the support pin 73 is so small as not to affect the filter performance, and also a plurality of (four in this embodiment) support pins 73 are arranged at intervals around the exhaust cylinder 34.

The present invention is not limited to the above-described embodiment, and it is a matter of course that modifications and changes can be made in the scope of the present invention. For example, although the dust collector provided in a self-propelled vacuum cleaner has been explained in this embodiment, the present invention can be applied to a dust collector installed in a general vacuum cleaner provided with a suction hose.

Also, the dust collection system is not limited to the cyclone system shown in the above-described embodiment. The present invention can also be applied to various dust collection systems in which dirt and dust are separated from air via a filter. Further, in the above-described embodiment, as the cleaning member, the ring and brush have been shown as an example. However, besides the brush, a material such as napped blanket, soft resin, and foamed material, which is cut into a suitable size, may be used to clean the filter by various operations such as "sweeping", "rubbing", "tapping", and "vibrating".

What is claimed is:

1. A dust collector, comprising:

a dust collection vessel having, an openable and closable cap, a case, an exhaust cylinder that has a filter and provided in the dust collection vessel, the dust collector filtering, by the filter, dirt and dust that have been sucked together with air from a suction port of the dust collection vessel, exhausting the air from the exhaust cylinder, and recovering the dirt and dust in the dust collection vessel, a cleaning member that cleans the filter, and provided movably along an axial direction of the exhaust cylinder; and a cap opening/closing interlocking unit that moves the cleaning member relative to the filter in association with an opening/closing operation of the cap, the cap opening/closing interlocking unit having a movable member which is movable in the axial direction with respect to the exhaust cylinder, a plurality of connecting members arranged at intervals around the filter to connect the movable member and the cleaning member to each other, and an urging member interposed between the exhaust cylinder and the movable member to urge the movable member in an extension direction with respect to the exhaust cylinder, wherein, the movable member moves in a retracting direction against an urging force of the urging member by making contact with the case as the cap adopts a closed posture.

2. A dust collector, comprising:

a dust collection vessel having, an openable and closable cap, case, an exhaust cylinder that has a filter and provided in the dust collection vessel, the dust collector filtering, by the filter, dirt and dust that have been sucked together with air from a suction port of the dust collection vessel, exhausting the air from the exhaust cylinder, and recovering the dirt and dust in the dust collection vessel, a cleaning member that cleans the filter and provided movably along an axial direction of the exhaust cylinder;

a cap opening/closing interlocking unit that moves the cleaning member relative to the filter in association with an opening/closing operation of the cap, the cap opening/closing interlocking unit having a movable member which is movable in the axial direction with respect to the exhaust cylinder, a connecting member for connecting the movable member and the cleaning member to each other, and an urging member that urges the movable member in an extension direction with respect to the exhaust cylinder; an accommodation portion for accommodating the urging member being provided on one side of the exhaust cylinder; and the moving member being arranged to cover the accommodation portion, wherein, the movable member moves in a retracting direction against an urging force of the urging member by making contact with the case as the cap adopts a closed posture.

3. The dust collector according to claim 1, wherein the movable member is seated on a bottom surface of the case when the cap adopts the closed posture.

4. The dust collector according to claim 1, wherein the cleaning member and the movable member are connected to each other by the connecting member so that the cleaning member is located in one end portion of the filter when the cap adopts the closed posture, and is located in the other end portion of the filter when the cap adopts an open posture.

5. A vacuum cleaner, comprising:

a cleaner body; and the dust collector according to claim 1 detachably provided in the cleaner body.

6. The vacuum cleaner according to claim 5, wherein the vacuum cleaner is a self-propelled vacuum cleaner which runs automatically in a space to perform cleaning.

7. The dust collector according to claim 2, wherein the movable member is seated on a bottom surface of the case when the cap adopts the closed posture.

8. The dust collector according to claim 2, wherein the cleaning member and the movable member are connected to each other by the connecting member so that the cleaning member is located in one end portion of the filter when the cap adopts the closed posture, and is located in the other end portion of the filter when the cap adopts an open posture.

9. A vacuum cleaner, comprising:

a cleaner body; and the dust collector according to claim 2 detachably provided in the cleaner body.

10. A vacuum cleaner, comprising:

a cleaner body; and the dust collector according to claim 3 detachably provided in the cleaner body.

11. A vacuum cleaner, comprising:

a cleaner body; and the dust collector according to claim 4 detachably provided in the cleaner body.

12. The dust collector according to claim 1, wherein the movable member moves in the retracting direction against the urging force of the urging member by making contact with an inside bottom surface of the case as the cap adopts the closed posture.

13. The dust collector according to claim 2, wherein the movable member moves in the retracting direction against the urging force of the urging member by making contact with an inside bottom surface of the case as the cap adopts the closed posture.

* * * * *